United States Patent [19]

Britt

[11] Patent Number: 4,843,527

[45] Date of Patent: Jun. 27, 1989

[54] MATRIX LAMP BANK DISPLAY AND LIGHT FILTERING ASSEMBLY

[75] Inventor: Ira Britt, Spokane, Wash.

[73] Assignee: American Sign & Indicator Corporation, Spokane, Wash.

[21] Appl. No.: 141,695

[22] Filed: Jan. 7, 1988

[51] Int. Cl.[4] ..... F21V 9/08

[52] U.S. Cl. ..... 362/231; 362/236; 362/242; 362/249; 362/812; 40/446; 40/550

[58] Field of Search ..... 362/231, 234, 235, 236, 362/242, 249, 812; 40/446, 447, 550, 541

[56] References Cited

U.S. PATENT DOCUMENTS

| | | | |
|---|---|---|---|
| 1,025,896 | 5/1912 | Zubli et al. | 362/811 |
| 1,888,377 | 11/1932 | Eschenbach | 40/564 |
| 2,154,109 | 11/1939 | Parks | 40/581 |
| 2,349,485 | 5/1944 | Corley | 362/236 |
| 3,222,985 | 12/1965 | Remesat | 362/293 |
| 3,227,040 | 1/1966 | Dauser | 362/293 |
| 3,425,146 | 2/1969 | Winstanley | 362/231 |
| 4,228,596 | 10/1980 | Daniel | 40/575 |
| 4,234,914 | 11/1980 | Boesen | 362/240 |
| 4,254,453 | 3/1981 | Mouyard et al. | 40/550 |
| 4,535,394 | 8/1985 | Dugre | 362/231 |
| 4,578,742 | 3/1986 | Klein et al. | 362/294 |
| 4,587,754 | 5/1986 | Ossner | 40/564 |
| 4,620,791 | 11/1986 | Combastet | 362/293 |
| 4,724,629 | 2/1988 | Walton | 40/447 |

FOREIGN PATENT DOCUMENTS

| | | | |
|---|---|---|---|
| 2548380 | 5/1977 | Fed. Rep. of Germany | 362/236 |

*Primary Examiner*—Ira S. Lazarus
*Assistant Examiner*—Sue Hagarman
*Attorney, Agent, or Firm*—Wells, St. John & Roberts

[57] ABSTRACT

A matrix lamp bank display utilizes individually removable light filtering assemblies that are composed of a rectangular tinted lens and a supporting frame. Each frame is removably mounted to the display at the front of the lamps provided within it. Each lens is inclined from the vertical to reduce sun or external lighting glare. Provision is made to accommodate thermal expansion of the lens and its supporting frame, as well as ventilation of each lens during lamp operation. Multicolored displays can be achieved by grouping two or more lens colors and operating multiple lamps in combination to project a desired color mix about the matrix.

25 Claims, 4 Drawing Sheets

FIG 7
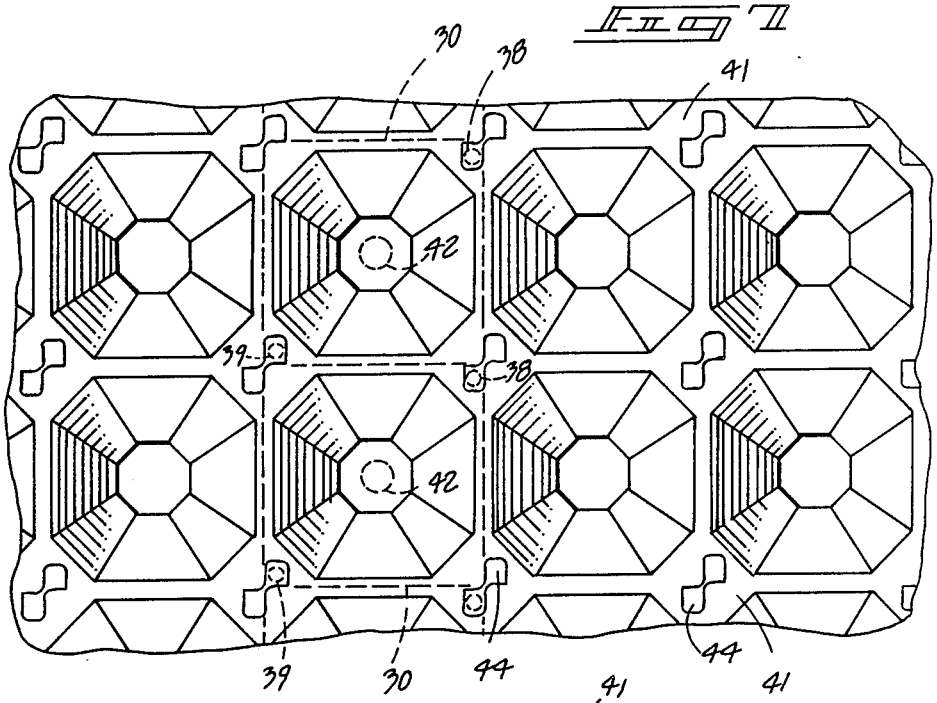
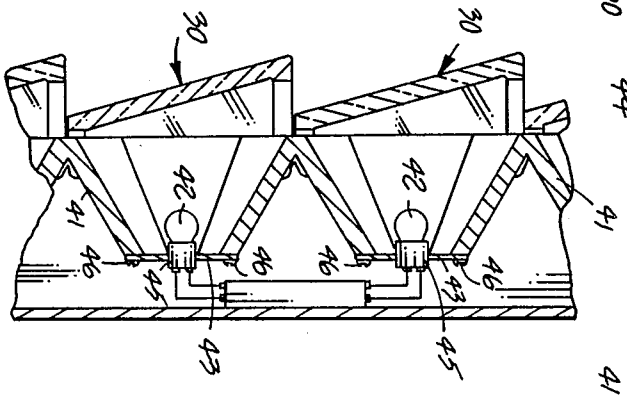
FIG 8

MATRIX LAMP BANK DISPLAY AND LIGHT FILTERING ASSEMBLY

TECHNICAL FIELD

This disclosure relates to illuminated matrix lamp bank display sin which selected lamps illuminate a desired configuration of letters or other images. It pertains a specific light filtering system that makes it possible to present colored displays, while using a common white light source.

BACKGROUND OF THE INVENTION

Matrix lamp bank displays are widely used for promotional and informational purposes along roads, inside and outside of buildings, and in sports facilities. They can display written announcements, information, and graphic images. Both the written and graphic presentations can be either static or moving.

Like television, the first matrix lamp bank displays exhibited black and white presentations achieved by simply turning white incandescent lamps on or off at selected locations or "pixels" about the matrix. While these lamp bank displays are still widely used, there is a growing desire to present colored images, paralleling the widespread adoption of color in television motion pictures, printing and other forms of visual and graphic art.

One way to achieve a color matrix lamp bank display is to utilize cathode ray tubes capable of projecting multiple colors in various shades of grey. Such matrix displays are used for "instant replay" video presentations, typically in large sports facilities. Their utilization is limited by the extreme cost of such an installation.

A less-expensive form of matrix color display can be achieved by grouping multiple light sources adjacent to one another to present the primary colors (typically 4 - white, red, blue and green). The group of lamps is then activated in the same manner as the individual lamps in a simple black and white matrix, selecting the primary colors desired for the color presentation of each grouped area. At the present, this has been accomplished by using colored light sources, selecting lamps of the color or combination of colors required at each group of lamps. Any cover or lens over these lamps has been of a common tint, typically clear so as to avoid any modification of the lamp color when viewed from the exterior of the display.

Colored incandescent lamp bulbs are substantially more expensive to install and maintain, when compared to the installation and upkeep of matrix lamp bank displays using white lamps. Maintenance of a color lamp bank display requires an inventory of four different lamps. The installation or replacement lamps risks the possibility that a lamp of the wrong color will be placed within a group. To resolve these difficulties, and to reduce the initial and continuing costs relating to a color matrix lamp bank display, the present invention was developed, using a common white lamp as a light source and interchangeable light filtering assemblies placed forward of each lamp. This not only allows for use of inexpensive lamps, it also permits replacement of all lamps from a single lamp inventory. It allows for greater light balance between the selected colors by incorporating such balance into the lens design, thereby eliminating light variations in color and intensity due to lamp construction and age.

Another object of this invention is to provide a covering lens system that permits access to each lamp from the front of the display, making lamp replacement much easier than in earlier installations where lamp access was only available from the rear. The light filtering assemblies are designed to accommodate wide temperature fluctuations that typically occur in the environment of matrix lamp bank displays, and particularly to accommodate the generation of heat by lamp energization.

The above objects have been accomplished by two different embodiments of the invention, which are disclosed in detail. One larger embodiment, adapted specifically for exterior display installations, utilizes a separable lens and supporting frame. The second embodiment, designed for smaller indoor installations, utilizes a lens and frame which are integrally molded. In both embodiments, the lens is positioned along an inclined plane that minimizes reflective glare from sunlight or adjacent ceiling light sources. In both embodiments there is provision for ventilation of the lens to permit heat to escape from about the light source located behind it. Both embodiments permit removal and installation of individual light filtering assemblies for initial manufacturing purposes, as well as field repairs and lamp replacement. These features will be more evident from the detailed disclosure that follows.

BRIEF DESCRIPTION OF THE DRAWINGS

The preferred embodiments of the invention are illustrated in the accompanying drawings, in which:

FIG. 7 is a fragmentary front view of a reflector sheet utilized in a matrix lamp bank display according to a second embodiment of the invention;

FIG. 8 is an enlarged fragmentary vertical sectional view taken through the second embodiment;

FIG. 9 is a front view of the light filtering assembly used in the second embodiment;

FIG. 10 is a top view;

FIG. 11 is a bottom view;

FIG. 12 is a rear view; and

FIG. 13 is a side view.

DETAILED DESCRIPTION OF THE PREFERRED EMBODIMENT

The following disclosure of the invention is submitted in compliance with the constitutional purpose of the Patent Laws "to promote the progress of science and useful arts" (Article 1, Section 8).

Figure 1:
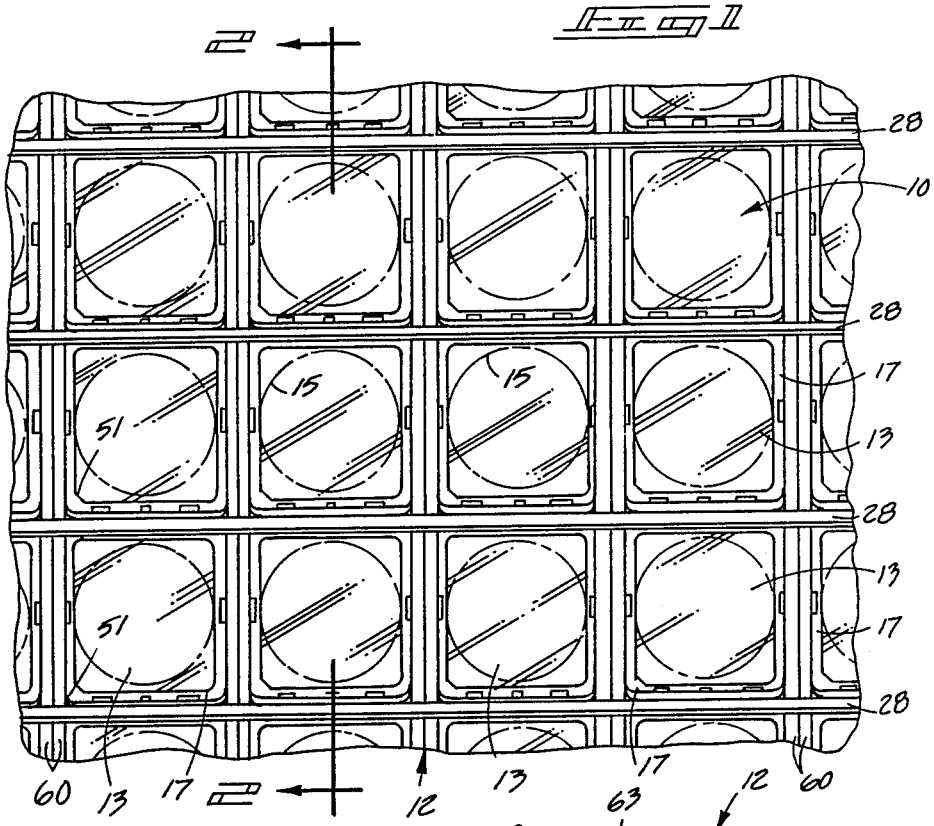
FIG. 1 is a fragmentary front view of a matrix lamp bank display utilizing a first embodiment of the invention.
Figure 2:
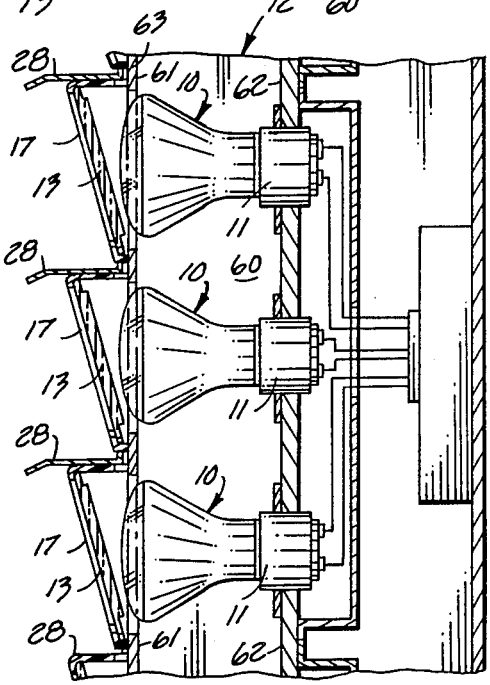
FIG. 2 is an enlarged fragmentary horizontal sectional view taken along line 2—2 in FIG. 1.
Figure 4:
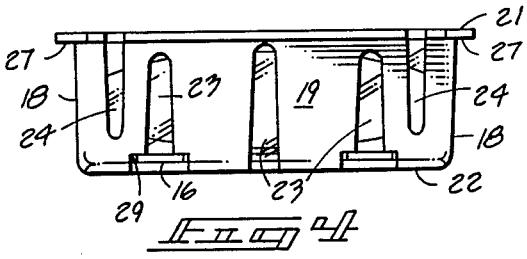
FIG. 4 is a top view.
Figure 3:
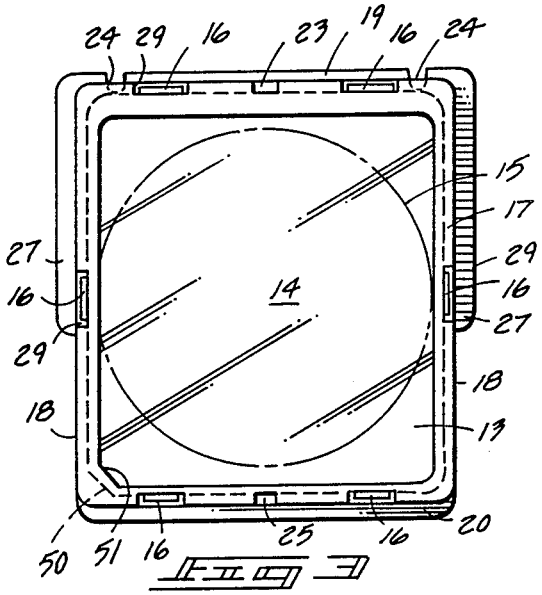
FIG. 3 is a front view of the light filtering assembly shown in FIG. 1.
Figure 5:
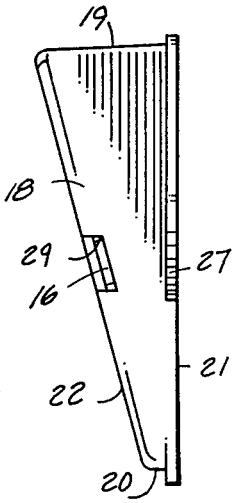
FIG. 5 is a side view.
Figure 6:
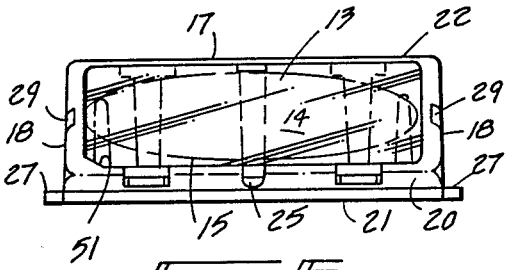
FIG. 6 is a bottom view.
Figure 4:
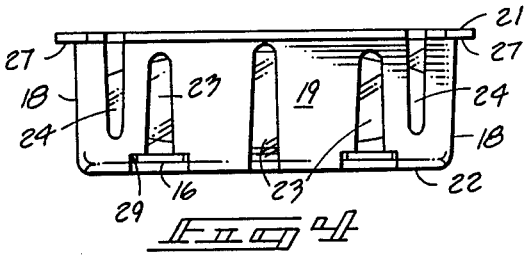
Figure 3:
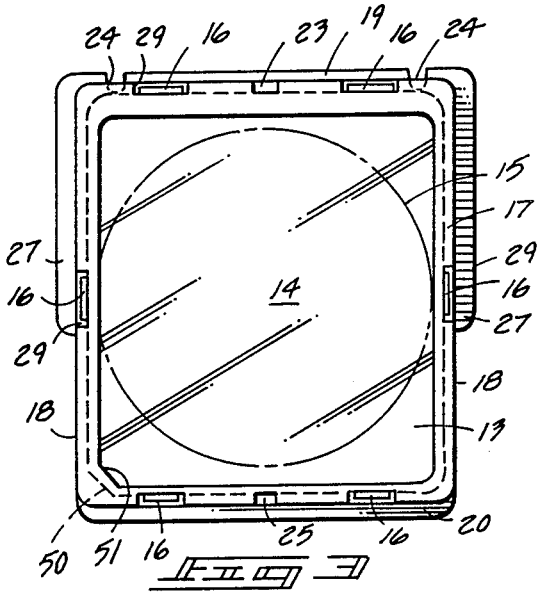
Figure 5:
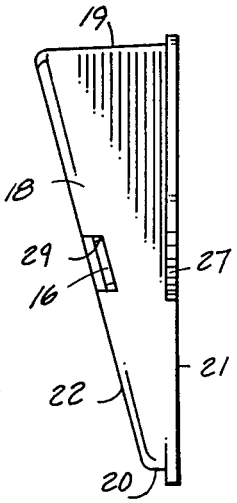
Figure 6:
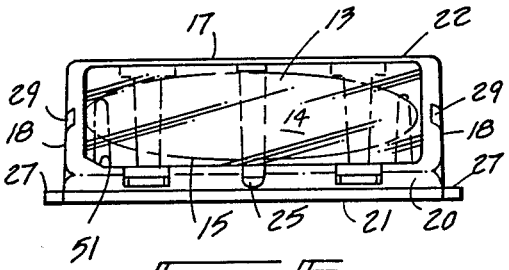

FIGS. 1–6 show a first embodiment of this invention, designed for larger exterior installations, while FIGS. 7–13 show details of a second embodiment designed for smaller interior installations. As an example, the lamps of the first embodiment might be located on 3 inch centers, while the lamps of the second embodiment might be located on centers spaced apart by $\frac{3}{4}$ of an inch.

screws or other suitable permanent fasteners. They structurally support the assembled frames 17, which freely rest on the weather shields 28 along each horizontal row in the completed matrix. The weather shields 28 prevent rain from entering through the slots 23 and 24 in the frame top wall 19. They also overlap the front of each lens 13 to assist in shading the lens front surface 14 from the sun or ceiling light sources.

Each frame 17 is held within the matrix framework 12 by means of co-planar flanges protruding oppositely outward adjacent the rear edge 21 of the frame. The flanges 27 are loosely received within complimentary mounting grooves 63 at the sides of extrusions 60 in the framework 12 to accommodate thermal expansion or contraction of the light filtering assembly. The slots 24 formed across the top wall 19 of frame 17 interrupt its rear edge 21 and permit the side walls 18 to be squeezed toward one another at rear edge 21 to facilitate entry of flanges 27 into the receiving slots that support frame 17 within framework 12.

The essential structural difference between the embodiment of this disclosure shown in FIGS. 1–6 and that shown in FIGS. 7–13 is that the second embodiment utilizes a lens that is integrally molded with its supporting frame. In this embodiment, the material within the lens and frame are therefore of the same tint, while the frame 17 of the first embodiment is preferably opaque. Both embodiments utilize a rectangular lens configuration, which permits the assembled lenses to substantially cover the front area of the assembled matrix lamp bank display. The rectangular lens shape also tends to visually enlarge the lighted area presented by the individual lamps, which are typically of a circular shape.

In the second embodiment, lens 30 and side walls 31 are integral. They retain the general shape described with regard to the embodiment in FIGS. 1–6. The lens 30 is surrounded by side walls 31, a top wall 32, and a bottom wall 33. The walls 31, 32, and 33 extend between a rear edge 34 and a front edge 35 that is coplanar with the front surface 36 of lens 30. Ventilating slots 37 are formed through the top wall 32. Each slot 37 interrupts the rear edge 34 across the top wall 32. The bottom wall 33 is recessed slightly to permit entry of air under the ends 30. The utilitarian aspects of these components are identical to those previously discussed with regard to the first embodiment.

In the smaller form of the invention, since space between adjacent light filtering assemblies is at a premium, attachment to the supporting structure is achieved by using rearwardly protruding posts 38 and 39. Posts 38 and 39 are located at diagonally opposite corners of the assembly as extensions of the walls that surround lens 30. It is preferable that there be at least two protruding posts 38 and 39 at opposite sides of the enclosure presented by walls 31, 32 and 33. A slot 40 is also formed through side wall 31 adjacent to the post 38 for permitting the post 38 to be deflected from its normal position as an extension of the walls 31 and 32 that intersect at the corner in which post 38 is formed. The outer ends of each post 38 and 39 are notched to interengage behind a wall surface to which the assembly is secured.

FIGS. 7 and 8 show one form of a matrix lamp bank display in which the second embodiment of the lens and frame can be effectively utilized. The assembly is built about a molded reflector plate 41 presenting a series of multi-faceted reflector recesses having central apertures for receiving small lamps 42. Each lamp 42 is mounted to a supporting printed circuit board 43 by means of individual sockets 45. The reflector plate 41 is fixed across the front of the printed circuit board 43 by screws 46 that engage rearwardly protruding bosses molded about the rear surface of the reflector plate 41 (FIG. 8). Reflector plate 41 is provided with complementary apertures 44 arranged about each reflector section to releasably receive the posts 38 and 39 of the individual light filtering assemblies mounted about the matrix lamp bank display.

Both embodiments of the invention readily lend themselves to multicolored lamp bank displays where differing colors are desired within adjacent lamp positions. Both provide maximum colored lens areas about a rectangular matrix lamp bank display, taking advantage of the corner areas surrounding individual lamps, as well as the areas immediately forward of them. Both embodiments facilitate thermal expansion by providing relatively flexible mounting between the lens and the supporting framework, and both facilitate ventilation of the lenses. Finally, both embodiments permit front access to the lamps for initial installation and replacement purposes.

In compliance with the statue, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

What is claimed:

1. A matrix lamp bank display for presenting a desired two dimensional pattern of lighted or unlighted light sources to a viewer, comprising:

an upright planar array of light sources directed parallel to one another in a common forward direction within a rectangular matrix in which the light sources are arranged in horizontal rows and vertical columns;

a corresponding array of light filtering assemblies located immediately forward of the light sources;

each light filtering assembly including:

an individual solid lens covering the front of one light source, each lens being individually inclined at an angle extending forwardly and upwardly from the planar array of light sources;

and individual frame means surrounding each lens, the frame means extending between each lens and the array of light sources for holding the lens in a location forward of one light source in the array;

the individual frame means each including a ventilated top wall extending rearwardly from the lens surrounded thereby.

2. The lamp bank display of claim 1 wherein the frame means includes a ventilated top wall extending rearwardly from the lens.

3. The lamp bank display of claim 1 wherein adjacent lenses are of differing colors within multi-colored groups.

4. The lamp bank display of claim 1 wherein the individual lenses and associated frame means are integrally molded.

5. The lamp bank display of claim 1 wherein the individual lenses are separate and removable from the individual frame means.

6. The lamp bank display of claim 1 wherein each lens includes a central area of protruding thickness extending substantially across its width and height, but terminating short of its peripheral edges.

7. The lamp bank display of claim 1 wherein each lens is rectangular in shape.

8. The lamp bank display of claim 1 wherein the frame means is constructed of opaque material.

9. The lamp bank display of claim 1 wherein the frame means is constructed of the same material as the lens held by it.

10. The lamp bank display of claim 1, further comprising:

mounting means for releasably attaching the frame means to the array, whereby the lens and frame means can be removed as a unit during replacement or repair of a light source located behind it.

11. The lamp bank display of claim 1 wherein the individual frame means comprises two side walls, a top wall and a bottom wall perpendicularly joined at their respective ends to form an open rectangular enclosure extending from a common planar rear edge to a common planar front edge that is inclined angularly in a forwardly and upwardly direction relative to its rear edge;

each lens extending cross the front of the frame means in a plane parallel to the common front edge of its walls.

12. The lamp bank display of claim 1 wherein the individual frame means comprises two side walls, a top wall and a bottom wall perpendicularly joined at their respective ends to form an open rectangular enclosure extending from a common planar rear edge to a common planar front edge that is inclined angularly in a forwardly and upwardly direction relative to its rear edge;

each lens extending cross the front of the frame means in a plane parallel to the common front edge of its walls; and mounting means for releasably attaching the frame means and lens to the array whereby the lens and frame means can be removed as a unit during replacement or repair of a light source located behind it.

13. A light filtering assembly usable in front of a forwardly-directed light source in a rectangular matrix lamp bank display in which a plurality of light sources are arranged in horizontal rows and vertical columns for presenting a desired two dimensional pattern of lighted or unlighted light sources to a viewer, comprising:

a peripheral frame having two side walls, a top wall and a bottom wall perpendicularly joined at their respective ends to form an open rectangular enclosure extending from a common planar rear edge to a common planar front edge that is inclined angularly in a forwardly and upwardly direction relative to its rear edge;

a single lens extending across the front of the frame in a plane parallel to the common front edge of its walls;

ventilation means in the top wall of the frame at a position rearwardly adjacent to the lens for permitting air heated by a light source to pass upwardly from behind the lens and to exit through the top wall of the frame as the heated air rises; and mounting means for selectively attaching the frame and lens to a supporting framework immediately forward of a single light source in a two dimensional matrix array.

14. The light filtering assembly of claim 13 wherein the ventilation means comprises a series of open slots formed through the top wall of the frame, each slot extending substantially across the space separating the front and rear edges of the frame across its top wall.

15. The light filtering assembly of claim 13 wherein the lens is translucent and tinted.

16. The light filtering assembly of claim 13 wherein the lens is separable from the frame and is releasably mounted to the frame by a series of protruding peripheral tabs about the lens and a complementary series of slots formed in the frame adjacent to the front edge of the enclosure.

17. The filtering assembly of claim 13 wherein the lens and frame are integrally molded.

18. The filtering assembly of claim 13 wherein the lens and frame are integrally molded of translucent, tinted plastic resin material.

19. The light filtering assembly of claim 13 wherein the lens is separate and removable from the frame.

20. The light filtering assembly of claim 13 wherein the lens includes a central area of protruding thickness extending substantially across its width and height, but terminating short of its peripheral edges.

21. The light filtering assembly of claim 13 wherein the frame is constructed of opaque material.

22. The light filtering assembly of claim 13 wherein the side walls of the frame are provided with coplanar flanges protruding oppositely outward adjacent the rear edge of the enclosure for attaching the frame to a support.

23. The light filtering assembly of claim 13 wherein the side walls of the frame are provided with coplanar flanges protruding oppositely outward adjacent the rear edge of the enclosure for attaching the frame to a support;

the ventilation means including at least one slotted opening interrupting the rear edge of the enclosure and permitting the side walls to be squeezed toward one another at the rear edge.

24. The light filtering assembly of claim 13 wherein the frame includes at least two protruding posts formed as rearward extensions of its walls at opposite sides of the enclosure for attaching the frame to a support.

25. The light filtering assembly of claim 13 wherein the frame includes at least two protruding posts formed as rearward extensions of its walls at opposite sides of the enclosure for attaching the frame to a support; at least one wall of the frame having a slot interrupting the rear edge of the enclosure adjacent to one post for permitting the post to be deflected from its normal position as an extension of the walls of the frame.

* * * * *